United States Patent [19]

Izuha et al.

[11] 4,422,391

[45] Dec. 27, 1983

[54] METHOD OF COMBUSTION OF PULVERIZED COAL BY PULVERIZED COAL BURNER

[75] Inventors: Akira Izuha, Koganei; Tomoyuki Shinano, Yokohama; Yuho Shibayama, Warabi; Chikatoshi Kurata, Akashi; Kenichi Fujii, Kobe, all of Japan

[73] Assignee: Kawasaki Jukogyo Kabushiki Kaisha, Kobe, Japan

[21] Appl. No.: 242,950

[22] Filed: Mar. 12, 1981

[51] Int. Cl.[3] ..... F23D 1/00

[52] U.S. Cl. ..... 110/347; 110/263

[58] Field of Search ..... 110/347, 263, 264; 431/10

[56] References Cited

U.S. PATENT DOCUMENTS

| | | | |
|---|---|---|---|
| 3,868,211 | 2/1975 | La Haye et al. | 431/10 |
| 3,914,091 | 10/1975 | Yamagishi et al. | 431/10 |
| 3,982,879 | 9/1976 | Pfefferle | 431/10 |
| 4,246,853 | 1/1981 | Mehta | 110/347 |
| 4,294,178 | 10/1981 | Borio | 110/347 |
| 4,308,810 | 1/1982 | Taylor | 110/347 |

*Primary Examiner*—Edwad G. Favors

*Attorney, Agent, or Firm*—Jordan and Hamburg

[57] ABSTRACT

A method of combustion of pulverized coal in two stages of combustion to reduce the amount of NOx produced by combustion. In a first stage, exhaust gas is added to air for combustion in a proportion of 35–60% of the air necessary for carrying out combustion. In a second stage, air for combustion is supplied in a proportion of 25–35% of the air necessary for carrying out combustion. In this method of combustion, the pulverized coal is combusted slowly at low temperature with the formation of a flame of low brightness to produce in large amounts activated intermediate components responsible for denitration reaction to promote reduction of produced NOx, and the concentration of CO produced can be reduced by abstaining from using the minimum air necessary for combustion.

2 Claims, 1 Drawing Figure

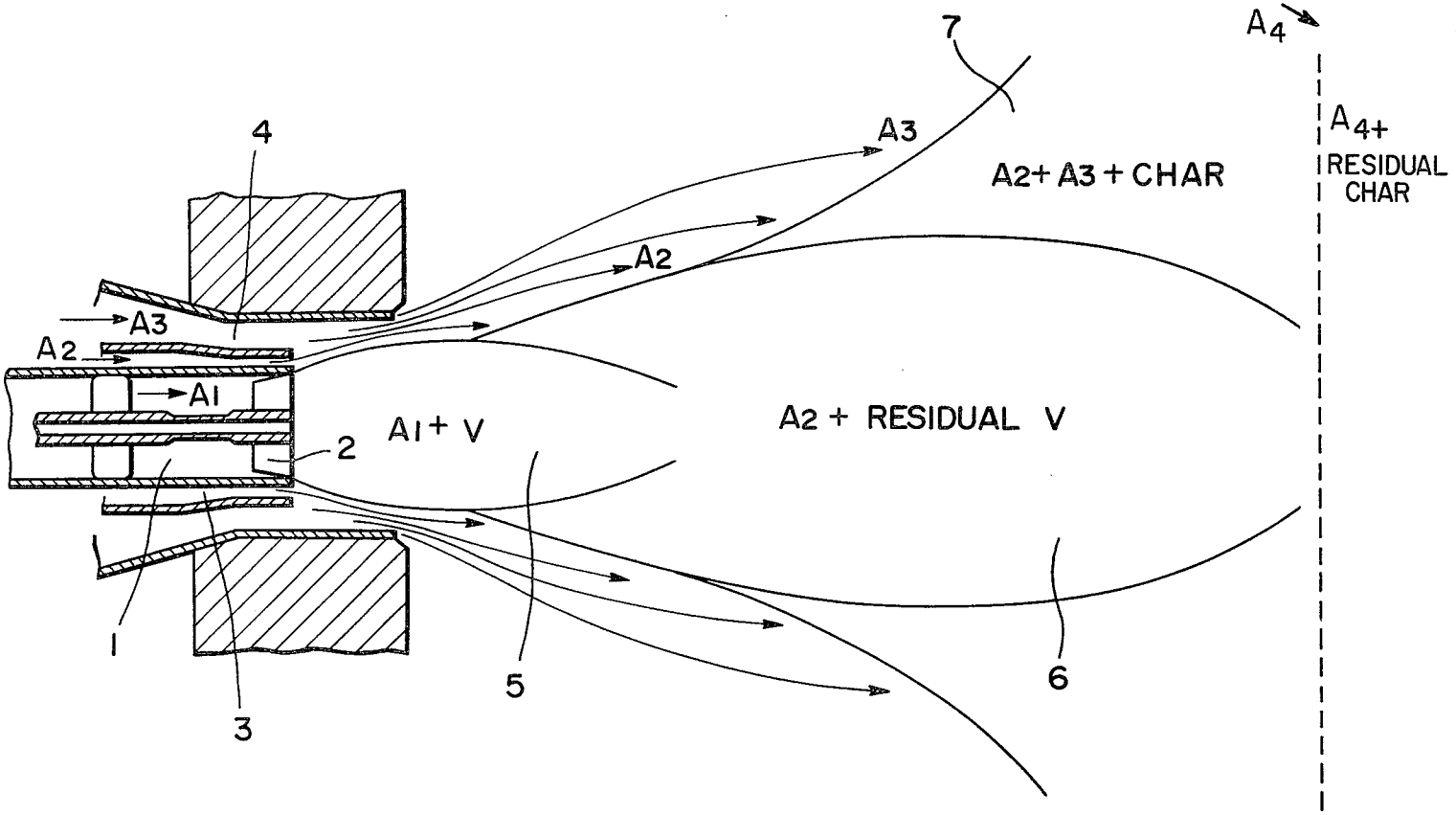
A4
A4+ RESIDUAL CHAR
A2+ A3 + CHAR
7
A3
A2
A2 + RESIDUAL V
6
5
A1 + V
2
4
3
A1
A3
A2
1

METHOD OF COMBUSTION OF PULVERIZED COAL BY PULVERIZED COAL BURNER

BACKGROUND OF THE INVENTION

This invention relates to improvements in or relating to the method of two-stage combustion of pulverized coal by means of a pulverized coal burner capable of reducing the amount of NOx produced by combustion.

When pulverized coal is combusted by a pulverized coal burner, NOx of an amount in the range between 500 and 600 ppm is produced as a result of complete combustion of the pulverized coal. Release into the atmosphere of the exhaust gas containing a large amount of NOx should be avoided from the point of view of avoiding air pollution. To this end, it has been earnestly desired that the amount of NOx produced by the combustion of pulverized coal be reduced as much as possible.

In our experience, two-stage combustion and exhaust gas recycling have effect in reducing the amount of NOx produced by the combustion of pulverized coal. In a two-stage combustion method of the prior art, it has hitherto been customary to burn pulverized coal in two steps by limiting the proportion of air for combustion in the second stage to 20% or less at most of the air required for combustion and by mixing the exhaust gas in a proportion of 20% or less or most. The reason for adopting these proportions is that if the proportion of air for combustion in the second stage is increased above the aforesaid limit, non-combusted air would increase in amount and if the exhaust gas is increased above the aforesaid limit, the combustion as a whole would become unstable. In the prior art, the amount of the NOx produced by the combustion of pulverized coal has only been reduced to the range between 200 and 300 ppm. With exhaust gas being added in a proportion of about 20%, the air necessary for combustion has a demand for a relatively high rate of $O_2$ and consequently diffusion of $O_2$ to the combustion zone occurs at high speed, so that the pulverized coal is essentially combusted at high temperature and at high speed with high $O_2$. The result of this is that the pulverized coal burns in non-homogeneous diffusion combustion, so that the flame has a high temperature and the amount of NOx produced increases due to rapid combustion of the pulverized coal with high $O_2$. Rapid combustion of the pulverized coal also produces non-combusted components, such as hydrocarbons which are activated intermediate products responsible for denitration reaction, $NH_3$, HCN and CO. These non-combusted components are combusted and disappear as soon as they are produced, so that they do not help in decomposition of NOx and the amount of the latter does not shown a reduction.

SUMMARY OF THE INVENTION

This invention has as its object the provision of a two-stage combustion method for a pulverized coal burner for reducing the amount of NOx produced by the combustion of pulverized coal.

In particular, the invention has been developed for the purpose of providing a combustion method for burning pulverized coal in two stages which is capable of reducing the amount of NOx produced by the combustion of pulverized coal to a value below 100 ppm. The results of research conducted by us show that the amount of NOx produced by the combustion of pulverized coal can be markedly reduced by causing the pulverized coal to burn slowly at low temperature with low $O_2$, and that the non-combusted components, including hydrocarbons which are activated intermediate products responsible for denitration reaction, $NH_3$, HCN and CO are produced in large amounts and exist for a prolonged period of time in non-combusted condition to enable decomposition of the produced NOx to take place vigorously.

The present invention is based on the aforesaid discovery and provides method of combustion of pulverized coal capable of positively reducing the amount of the produced NOx to a value below 100 ppm by effectively carrying out combustion of the pulverized coal at low speed and at low temperature with low $O_2$, regardless of whether the pulverized coal is of high quality or low quality.

The aforesaid object can be accomplished according to the invention by a method of combustion of pulverized coal comprising the steps of burning the pulverized coal by adding exhaust gas to air for combustion in a proportion which is in the range between 35 and 60% of the air required for carrying out combustion in a first stage of combustion, and carrying out combustion by supplying air for second stage combustion in a proportion which is on the range between 25 and 35% of the air necessary for combustion in a second stage of combustion.

BRIEF DESCRIPTION OF THE DRAWING

The single drawing is a sectional view showing the condition of combustion of pulverized coal by a pulverized coal burner.

DESCRIPTION OF THE PREFERRED EMBODIMENT

In the method according to the invention for the combustion of pulverized coal, pulverized coal 1 is supplied together with primary air $A_1$ through a combustion air outlet 1 of a pulverized coal burner and caused by a swirler 2 to be injected into the furnace while flowing slowly in vortical form. Secondary air $A_2$ is injected into the furnace with exhaust gas through an inner annular outlet 3 surrounding the combustion air outlet 1, the secondary air either flowing slowly in vortical form or not flowing in vortical form as the case may be. Tertiary air $A_3$ is injected into the furnace with exhaust gas through an outer annular outlet 4 surrounding the inner annular outlet 3 while flowing in vortical form. Pulverized coal supplied to the furnace together with primary air is combusted to form a primary flame 5. The primary flame 5 is formed by slow combustion of the pulverized coal at low temperature with low $O_2$ and is low in brightness, because the primary air $A_1$ is about 20–30% in amount of the air necessary for combusting all the pulverized coal supplied therewith to the furnance and mixing of secondary and tertiary air therewith is prohibited. Combustion of a volatile component V of the pulverized coal is mainly responsible for formation of the primary flame 5, so that the pulverized coal is combusted slowly at low temperature with a flame of low brightness. In this type of combustion, production of NOx is greatly produced and the non-combusted components, such as hydrocarbons which are activated intermediate products responsible for denitration reaction, $NH_3$ HCN and CO, are produced in large amounts and exist for a prolonged period of time in non-combusted condition. Thus these non-combusted components react with NOx, to ultimately reduce the NOx to $N_2$. Char which is produced in large amounts as a non-combusted component of the primary flame 5 is combusted in the secondary flame 6. The residual volatile component is combusted mainly by the secondary air $A_2$ ejected through the inner annular outlets 3 to form a secondary flame 6. Most of char is combusted by the secondary air $A_2$ and the tertiary air $A_3$ to form a tertiary flame range 7. The secondary flame 6 and the tertiary flame 7 are formed by the combustion of relatively low speed and low temperature with low $O_2$, because the secondary and tertiary air is about 55–80% in amount of the air necessary for the combustion of all the pulverized coal and the air contains exhaust gas in 35–60%.

The secondary flame 6 and the tertiary flame 7 are thus in condition of air deficiency as a whole, but burns slowly so that $O_2$ exists therein although it is low in concentration. The reduced substances (activated intermediate products), such as hydrocarbons, $NH_3$, HCN and CO, produced gradually from the char, react in the presence of $O_2$ with NOx produced on the upstream side, to reduce NOx to $N_2$. In the tertiary flange range 7 reductive denitration is promoted more than NOx production under the reductive circumstances. Therefore, the reduction of NOx is performed in this range.

Combustion of the non-combusted components (residual char) is completed in a rear portion of the tertiary flame region 7 when two stage combustion air $A_4$ is supplied, in an amount which is 25–35% of the air necessary for combusting all the pulverized coal, to the furnace in which combustion is taking place with the formation of a flame of low brightness by the combustion of the pulverized coal at low speed and at low temperature with noncatalytic denitration.

The reason why the proportion of the exhaust gas mixed with the air for combustion is set at 35–60% of the air necessary for combusting the pulverized coal in the method of combustion of pulverized coal according to the inventions as follows. When the proportion is below 35%, the air necessary for combusting the pulverized coal has a relatively high demand for $O_2$ and the speed of diffusion of $O_2$ to the combustion zone is high, so that the pulverized coal is combusted quickly at high temperature. The combustion is nonhomogeneous diffusion combustion with a formation of bright flame, so that the amount of NOx produced in the combustion increases. When the proportion is above 60%, the demand for $O_2$ of the air necessary for combusting the pulverized coal becomes so low that the speed of diffusion of $O_2$ to the combustion zone becomes too low to prevent the phenomenon of noncombustion from taking place or to avoid incomplete combustion of the pulverized coal. The result of this is that non-combusted components of high concentration, particularly CO, are produced. Thus the range between 35 and 60% is preferred. When the value is within this range, it is possible to reduce the amount of NOx produced in the combustion of pulverized coal to a value below 100 ppm, regardless of whether coal is high or low in quality.

The reason why the proportion of air for combustion in the second stage is set at 25–35% of the air necessary for combusting the pulverized coal in the method of combustion of pulverized coal according to the invention is as follows. When the proportion is below 25%, the amounts of the non-combusted components (hydrocarbons, $NH_3$, HCN and CO) necessary for promoting the reduction of NOx which are produced are too small to permit the concentration of NOx to be reduced to a valve below 100 ppm. When the proportion is above 35%, the amounts of the non-combusted components which are produced are excessive, so that although the amount of NOx is reduced, completion of the combustion of the non-combusted components is delayed in spite of the incorporation of the air for combustion in the second stage. Thus the range between 25 and 35% is preferred. When the valve is within this range, it is possible for the method of combustion according to the invention to cope with combustion of pulverized coal of both high and low quality.

To enable the effects achieved by the method of combustion of pulverized coal according to the invention to be better understood, the examples of the invention will now be described in comparison with the prior art.

PRIOR ART

In combusting coal mined in Japan (Sorachi coal) in pulverized form by a 3 T/H burner, combustion of the pulverized coal was carried out in two stages. In the first stage, exhaust gas was mixed with air for combustion in a proportion of 20% of the air necessary for carrying out combustion. In the second stage, air for combustion was in a proportion of 20% of the air necessary for carrying out combustion.

EXAMPLE 1 (THE INVENTION)

In combusting coal mined in Japan (Sorachi coal) in pulverized form by a 3 T/H burner, combustion of the pulverized coal was carried out in two stages. In the first stage, exhaust gas was mixed with air for combustion in a proportion of 35% of the air necessary for carrying out combustion. In the second stage, air for combustion was in a proportion of 26% of the air necessary for carrying out combustion.

EXAMPLE 2 (THE INVENTION)

In combusting coal mined in Japan (Sorachi coal) in pulverized form by a 3 T/H burner, combustion of the pulverized coal was carried out in two stages. In the first stage, exhaust gas was mixed with air for combustion in a proportion of 41% of the air necessary for carrying out combustion. In the second stage, air for combustion was in a proportion of 30% of the air necessary for carrying out combustion.

EXAMPLE 3 (THE INVENTION)

In combusting coal mined in Japan (Sorachi Coal) in pulverized form by a 3 T/H burner, combustion of the pulverized coal was carried out in two stages. In the first stage, exhaust gas was mixed with air for combustion in a proportion of 55% of the air necessary for carrying out combustion. In the second stage, air for combustion was in a proportion of 34% of the air necessary for carrying out combustion.

The concentrations of NOx and CO detected in the exhaust gases of combustion of the pulverized coal carried out in two stages in the prior art and by the method according to the invention were measured. The results are shown in Table 1.

TABLE 1

| | Concentration of NOx (ppm) | Concentration of CO (ppm) |
|---|---|---|
| Prior Art | 250 | 92 |

TABLE 1-continued

| | Concentration of NOx (ppm) | Concentration of CO (ppm) |
|---|---|---|
| Example 1 | 90 | 65 |
| Example 2 | 61 | 83 |
| Example 3 | 31 | 90 |

As can be clearly seen in Table 1, the exhaust gases produced in Examples 1–3 of the present invention in which combustion of pulverized coal was combusted in two stages contained NOx and CO in concentrations lower than in the prior art in which combustion of pulverized gas was also carried out in two stages. This shows that the method of combustion according to the invention has marked effects in reducing the amounts of NOx and CO in the exhaust gases.

From the foregoing description, it will be appreciated that in the method of combustion of pulverized coal by using a pulverized coal burner according to the invention, the pulverized coal is combusted in a first stage of combustion with air mixed with exhaust gas in a proportion of 35–60% of the air necessary for combusting the pulverized coal so that the combustion takes place slowly at low temperature with the formation of a flame of low brightness. Thus the NOx produced in combustion is reduced in amount and the NOx produced has its concentration reduced by being reduced to N2 by char and non-combusted components (hydrocarbons, $NH_3$, NCN and CO) which are spread widely in the furnace and exist for a long period of time. In a second stage of combustion, second stage combustion air is supplied in a proportion of 25–35% of the air necessary for carrying out combustion to burn non-combusted CO and char, to reduce the concentration of CO. Thus the invention can achieve the excellent result of reducing the concentration of CO in the exhaust gas.

What is claimed is:

1. A method of combustion of pulverized coal by a pulverized coal burner, comprising the steps of:

combusting the pulverized coal by supplying thereto air for combustion mixed with exhaust gas in a proportion of 35–60% of the air necessary for carrying out combustion in a first stage of combustion; and supplying to a flame formed in the first stage of combustion air for combustion in a proportion of 25–35% of the air necessary for carrying out combustion.

2. A method of combustion of pulverized coal by a pulverized coal burner, comprising the steps of:

carrying out combustion in a first stage in which a primary flame is formed by mixing the pulverized coal with primary air in a proportion of 20–30% of the air necessary for combusting all the pulverized coal mixed with the primary air, a secondary flame is formed by supplying to the residual volatile of the pulverized coal mainly a mixture of secondary air with exhaust gas, and a tertiary flame is formed by combusting most of char with the secondary air and a tertiary air mixed with the exhaust gas, wherein said secondary and tertiary air used in the second and tertiary flame being in a proportion of 55–80% of the air necessary for combusting all the pulverized coal and said exhaust gas being in a proportion of 35–60% of the air necessary for carrying out combustions; and carrying out combustion in a second stage in which two stage air is supplied in a proportion of 25–35% of the air necessary for carrying out combustion.

* * * * *